US005316722A

United States Patent [19]

Sugizaki et al.

[11] Patent Number: 5,316,722

[45] Date of Patent: May 31, 1994

[54] CORROSION RESISTANT TI-CR-NI ALLOY CONTAINING A PLATINUM GROUP METAL

[75] Inventors: Yasuaki Sugizaki; Keiji Ueda; Hiroshi Satoh; Hidetoshi Nishimoto; Tatsuya Yasunaga; Takashi Yashiki, all of Kobe, Japan

[73] Assignee: Kabushiki Kaisha Kobe Seiko Sho, Kobe, Japan

[21] Appl. No.: 911,077

[22] Filed: Jul. 9, 1992

[51] Int. Cl.[5] ..... C22C 14/00

[52] U.S. Cl. ..... 420/421; 148/421; 420/417

[58] Field of Search ..... 420/417, 421; 148/421

[56] References Cited

U.S. PATENT DOCUMENTS

| | | | |
|---|---|---|---|
| 3,063,835 | 11/1962 | Stern | 420/417 |
| 3,532,559 | 10/1970 | Gullotti | 420/417 |
| 4,139,373 | 2/1979 | Notton | 420/417 |
| 4,859,415 | 8/1989 | Shida et al. | 420/419 |

FOREIGN PATENT DOCUMENTS

| | | | |
|---|---|---|---|
| 0116738 | 6/1985 | Japan | 420/421 |

*Primary Examiner*—Upendra Roy

*Attorney, Agent, or Firm*—Oblon, Spivak, McClelland, Maier & Neustadt

[57] ABSTRACT

A corrosion resistant Ti based alloy comprising:

Cr: 0.005–2.0 wt %, and further comprising one or more of elements selected from:

| | |
|---|---|
| Ni: 0.005–2.0 wt %, | Pd: 0.005–2.0 wt %, |
| Ru: 0.005–2.0 wt %, | Pt: 0.005–2.0 wt %, |
| Os: 0.005–2.0 wt %, | Ir: 0.005–2.0 wt %, |
| Rh: 0.005–2.0 wt %, and | |

the balance of Ti and inevitable impurities.

Cr may be replaced with one or more of 0.005–1.5 wt % of Cu and 0.005–1.5 wt % of Si, or 0.005–2.0 wt % of Al. The corrosion resistant Ti based alloy has excellent corrosion resistance also in a non-oxidative atmosphere and also has an excellent crevice corrosion resistance.

1 Claim, 15 Drawing Sheets (X100)

MATERIAL 1 OF THE INVENTION FORGED MATERIAL (SURFACE)

(X100)

MATERIAL 1 OF THE INVENTION FORGED MATERIAL (CROSS SECTION)

(X100)

MATERIAL 2 OF THE INVENTION COLD-ROLLED MATERIAL (SURFACE)

(X100)

MATERIAL 2 OF THE INVENTION COLD-ROLLED MATERIAL (CROSS SECTION)

(X100)

c.p. Ti (COMPARATIVE EXAMPLE 1, JIS: SECOND CLASS)

(X100)

Ti-Pd (COMPARATIVE EXAMPLE 2, JIS: 12TH CLASS)

(X100)

Ti-Ni-Ru (COMPARATIVE EXAMPLE 3)

(X100)

Ti-Pd-Co (COMPARATIVE EXAMPLE 4)

VICKERS HARDNESS FOR EACH OF THE TEST MATERIALS

UNIFORM CORROSION RATE IN BOILING HCl

PROBABILITY FOR THE OCCURRENCE OF CREVICE CORROSION

UNIFORM CORROSION RATE OF SIMULATED WELDED SPECIMEN (X500)

FORGED MATERIAL OF THE PRESENT INVENTION 1

(X500)

COLD-ROLLED MATERIAL OF THE PRESENT INVENTION 2

(X500)

c.p. Ti (COMPARATIVE EXAMPLE 1, JIS : SECOND CLASS)

(X500)

Ti-Ni-Ru (COMPARATIVE EXAMPLE 3)

CORROSION RESISTANT TI-CR-NI ALLOY CONTAINING A PLATINUM GROUP METAL

BACKGROUND OF THE INVENTION

1. Field of the Invention

The present invention concerns a corrosion resistant Ti based alloy and, more particularly, it relates to a corrosion resistant Ti based alloy of excellent corrosion resistance, as well as workability and crevice corrosion resistance.

2. Description of the Prior Art

Heretofore, Ti has been well-known as a metal of excellent resistance and used generally as an industrial structural material such as chemical plants, but there is a room for doubt about the corrosion resistance depending on the circumstances in which it is used.

Ti shows excellent corrosion resistance in an oxidative corrosive circumstance such as of nitric acid and in corrosive circumstance containing sea water and like other chlorides. However, in a non-oxidative circumstance such as hydrochloric acid and sulfuric acid, it does not show so excellent corrosion resistance as in the oxidative circumstance as described above.

Further, in a circumstance containing, for example, a chloride solution at high temperature it has been well-known that, if crevices are present in the material put under the circumstance, Ti in the crevices locally suffers from corrosion.

For resolving such problems when Ti is put to a readily corrosive circumstance, corrosion resistant Ti based alloys incorporating various alloying elements to Ti have already been proposed and commercially available.

Then, as the Ti alloys, there can be mentioned such alloys as Ti-Pd alloy and Ti-Ni-Mo alloy. However, Ti-Pd alloy involves an economical problem since Pd is expensive and Ti-Ni-Mo alloy has a problem of poor workability and it has not been used generally although it is excellent in the corrosion resistance.

Accordingly, the present inventors, taking notice of the problems in the Ti alloys which are said to have satisfactory corrosion resistance in the prior art, have already proposed Ti alloys which show excellent corrosion resistance in the non-oxidative circumstance and, further, can satisfy crevice corrosion resistance in such circumstance as in the chloride solution at high temperature in view of the practical use in Japanese Patent Application Hei 02-069066 and 02-283755, and have developed a Ti alloy incorporated with Ag or Au to a group of Ni, Pd or Ru.

However, the Ti based alloy exhibits excellent performance in the corrosion resistance which is an object of the corrosion resistant Ti based alloy according to the present invention but Ag, etc. incorporated in a melting device for the Ti based alloy gives loss by evaporation, making it difficult to conduct alloy casting at a good yield.

OBJECT OF THE INVENTION

In view of the foregoing problems in the prior art, it is an object of the present invention to provide a Ti based alloy having excellent corrosion resistance in view of the demand for the development of the Ti alloy capable of satisfying corrosion resistance, easy to be prepared economically.

SUMMARY OF THE INVENTION

The foregoing object of the present invention can be attained, in accordance with the first feature of the present invention, by a corrosion resistant Ti based alloy comprising:

Cr: 0.005–2.0 wt %, and further comprising one or more of elements selected from the group consisting of:

| | |
|---|---|
| Ni: 0.005–2.0 wt %, | Pd: 0.005–2.0 wt %, |
| Ru: 0.005–2.0 wt %, | Pt: 0.005–2.0 wt %, |
| Os: 0.005–2.0 wt %, | Ir: 0.005–2 0 wt %, |
| Rh: 0.005–2.0 wt %, | |

and the balance of Ti and inevitable impurities, with the second feature of the present invention, by a corrosion resistant Ti based alloy comprising: one or more of elements selected from:

Cu: 0.005–1.5 wt % and Si: 0.005–1.5 wt % and further comprising one or more of elements selected from:

| | |
|---|---|
| Ni: 0.005–2.0 wt %, | Pd: 0.005–2.0 wt %, |
| Ru: 0.005–2.0 wt %, | Pt: 0.005–2.0 wt %, |
| Os: 0.005–2.0 wt %, | Ir: 0.005–2.0 wt %, |
| Rh: 0.005–2.0 wt %, | |

and the balance of Ti and inevitable impurity, and with the third feature of the present invention, by a corrosion resistant Ti based alloy comprising:

Al: 0.005–2.0 wt %, and further comprising one or more of elements selected from:

| | |
|---|---|
| Ni: 0.005–2.0 wt %, | Pd: 0.005–2.0 wt %, |
| Ru: 0.005–2.0 wt %, | Pt: 0.005–2.0 wt %, |
| Os: 0.005–2.0 wt %, | Ir: 0.005–2.0 wt %, |
| Rh: 0.005–2.0 wt %, | |

and the balance of Ti and inevitable impurities.

DESCRIPTION OF THE PREFERRED EMBODIMENTS OF THE INVENTION

Description will now be made more specifically to the corrosion resistant Ti based alloy according to the present invention.

Description will at first be made to the ingredients and the ratio thereof contained in the corrosion resistant Ti based alloy according to the present invention.

In the corrosion resistant Ti based alloy according to the present invention, a number of various alloys were prepared for looking for such elements as not giving undesired effects on the workability and studies have been made on the corrosion resistance and crevice corrosion resistance and have made examination on alloying elements which do not worsening the workability and are excellent in the corrosion resistance and the crevice corrosion resistance and, as a result, the elements described later have been found.

Cr is an element that contributes to the corrosion resistance and the crevice corrosion resistance without giving undesired effects on the workability. The effect is insufficient if the content is less than 0.005 wt % and, on the other hand, the workability is deteriorated if the content is greater than 2.0 wt %. Accordingly, the Cr content is defined as from 0.005 to 2.0 wt %. Further, when Cr is contained within the range described above and, further, one or more of Ni, Pd, Ru, Pt, Os, Ir, Rh is contained by from 0.005 to 2.0 wt %, the corrosion resistance can be improved remarkably by the synergistic effect. On the other hand, if Ni, Pd, Ru, Pt, Os, Ir or Rh is added solely by from 0.005 to 2.0 wt %, no corrosion resistance equal to that of a Ti-Pd alloy is not obtained in the non-oxidative atmosphere.

Cu and Si are element that improves the corrosion resistance and the crevice corrosion resistance without giving undesired effects on the workability. The effect can not be expected if the content is less than 0.005 wt % and, on the other hand, the workability was worsened if it is contained by more than 1.5 wt %. Accordingly, the Cu content is defined as from 0.005 to 1.5 wt % and the Si content is defined as from 0.005 to 1.5 wt %. on the other hand, if Cu or Si is incorporated solely to Ti, there is less effect for improving the corrosion resistance in the non-oxidative circumstance. Then, when one or more of Cu and Si is contained within a range from 0.005 to 1.5 wt % and one or more of Ni, Pd, Ru, Pt, Os, Ir and Rh is contained by from 0.005 to 2.0 wt %, the corrosion resistance can be improved remarkably by the synergistic effect to an extent equal to or greater than that of the existent Ti-Pd alloy.

Al is an element that contributes to the corrosion resistance and the crevice corrosion resistance without deteriorating the workability. The effect is insufficient if the content is less than 0.005 wt % but, on the other hand, the workability is worsened if it is greater than 2.0 wt %. Accordingly, the Al content is defined as from 0.005–2.0 wt %. Further, if Al is incorporated solely to Ti, it does not exhibit a corrosion resistance equal to that of the Ti-Pd alloy in the non-oxidative atmosphere. When one of Ni, Pd, Ru, Pt, Os, Ir and Rh is contained within a range from 0.005 to 2.0 wt % to Ti, the corrosion resistance can be removed remarkably in a non-oxidative circumstance by the synergistic effect.

Then, the corrosion resistance can be improved by incorporating Cr, Cu, Si and Al described above each alone or in combination.

When Ni, Pd, Ru, Pt, Os, Ir or Rh is added alone by from 0.005 to 2.0 wt % Ti, no improvement is recognized for the corrosion resistance in the non-oxidative circumstance but remarkable improvement is recognized for the corrosion resistance in the coexistence of Cr, Cu and Si, Al as described above. Accordingly, excellent corrosion resistance can be obtained by incorporating one or more of Ni, Pd, Ru, Pt, Os, Ir and Rh within a range from 0.005 to 2.0 wt % of the content.

BRIEF EXPLANATION OF THE ACCOMPANYING DRAWINGS

EXAMPLE

Description will be made to examples of the corrosion resistant Ti based alloy according to the present invention together with comparative examples.

EXAMPLE 1

Ti alloys shown in Tables 1 and 2 were prepared by incorporating each of metal powders of the ingredients into sponge titanium (JIS: first class) while varying the ratio of the ingredients and melting them into cast ingots in a vacuum arc melting furnace. Further, as comparative examples, pure titanium cast ingots comprising only sponge titanium (JIS: first class) were prepared by melting.

The cast ingots were put to hot forging and hot rolling to prepare plates of 1.0 mm thickness.

After applying a vacuum annealing heat treatment to the plates, test pieces for corrosion resistance of 20 mm in diameter and 1 mm in thickness were sampled.

Further, as comparative examples, a material corresponding to commercially available G2 (pure Ti), a material corresponding to G7 (Ti-0.15 Pd) and a material corresponding to G12 (Ti-0.8 Ni-0.3 Mo) were also prepared.

An evaluation test to be described below was carried out.

42% $MgCl_2$ Crevice Corrosion Immersion Test

Figure 1:
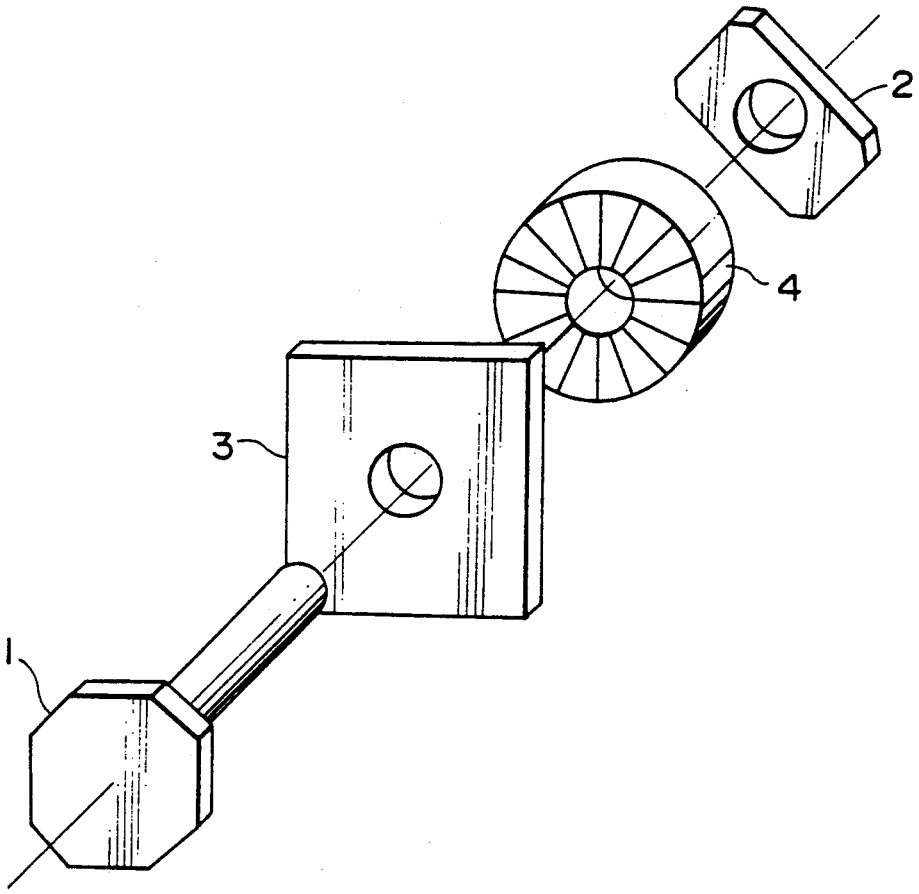
FIG. 1 shows a jig for testing crevice corrosion resistance.

In this test, a jig prepared by assembling a Ti bolt 1, T.P 3, a multicrevice of 20 mm diameter (with grooves, made of teflon) 4 and a Ti nut 2 shown in FIG. 1 was immersed in a 42% $MgCl_2$ solution simulating a crevice corrosion circumstance for 48 hours and evaluated depending on the occurrence of crevice corrosion.

Table 3 shows the results of the crevice corrosion resistance test.

TABLE 1

| | Chemical ingredient (wt %) | | | | |
|---|---|---|---|---|---|
| | Cr | Ni | Pd | Ru | Ti |
| This invention | | | | | |
| 1 | 0.2 | 0.005 | — | — | Balance |
| 2 | 0.2 | 0.1 | — | — | " |
| 3 | 0.2 | 0.5 | — | — | " |
| 4 | 0.2 | 2.0 | — | — | " |
| 5 | 0.2 | — | 0.005 | — | " |
| 6 | 0.2 | — | 0.015 | — | " |
| 7 | 0.2 | — | 0.1 | — | " |
| 8 | 0.2 | — | — | 0.005 | " |
| 9 | 0.2 | — | — | 0.005 | " |
| 10 | 0.2 | — | — | 0.1 | " |
| 11 | 0.2 | — | 0.006 | 0.015 | " |
| 12 | 0.2 | 0.5 | 0.015 | 0.025 | " |
| 13 | 0.2 | 0.5 | 0.025 | 0.015 | " |
| 14 | 0.005 | 0.5 | 0.015 | 0.025 | " |
| 15 | 0.05 | 0.5 | 0.015 | 0.025 | " |
| 16 | 0.50 | 0.5 | 0.015 | 0.025 | " |
| 17 | 1.00 | 0.5 | 0.015 | 0.025 | " |
| 18 | 2.0 | 0.5 | 0.015 | 0.025 | " |

TABLE 2

| | Chemical ingredient (wt %) | | | | |
|---|---|---|---|---|---|
| | Cr | Ni | Pd | Ru | Ti |
| Comparative Example | | | | | |
| 1 | Pure Ti (material corresponding to G2) | | | | |
| 2 | Ri - 0.8 Ni - 0.3 Mo (material corresponding to G12) | | | | |
| 3 | 0.2 | — | — | — | Balance |
| 4 | — | 0.5 | — | — | " |
| 5 | — | — | 0.15 | — | " |
| 6 | — | — | — | 0.15 | " |
| 7 | — | 0.5 | 0.015 | 0.025 | " |

TABLE 3

| | Crevice corrosion | | Crevice corrosion |
|---|---|---|---|
| This invention | | This invention | |
| 1 | ○ | 14 | ○ |
| 2 | ○ | 15 | ○ |
| 3 | ○ | 16 | ○ |
| 4 | ○ | 17 | ○ |
| 5 | ○ | 18 | ○ |
| 6 | ○ | Comparative Example | |
| 7 | ○ | 1 | x |
| 8 | ○ | 2 | ○ |
| 9 | ○ | 3 | x |
| 10 | ○ | 4 | x |
| 11 | ○ | 5 | ○ |
| 12 | ○ | 6 | ○ |
| 13 | ○ | 7 | ○ |

○ - crevice corrosion occurred
x - no crevice corrosion occurred

As apparent from Table 3, the corrosion resistant Ti based alloy according to the present invention (in claim 1) shows excellent crevice corrosion resistance in the test immersed in a boiling 42% $MgCl_2$ solution for 42 hours.

Description will then be made to the entire surface corrosion resistance evaluation test for the corrosion resistant Ti based alloy according to the present invention (invention in (claim 1)) against hydrochloric acid with reference to FIG. 2–FIG. 5.

Figure 2:
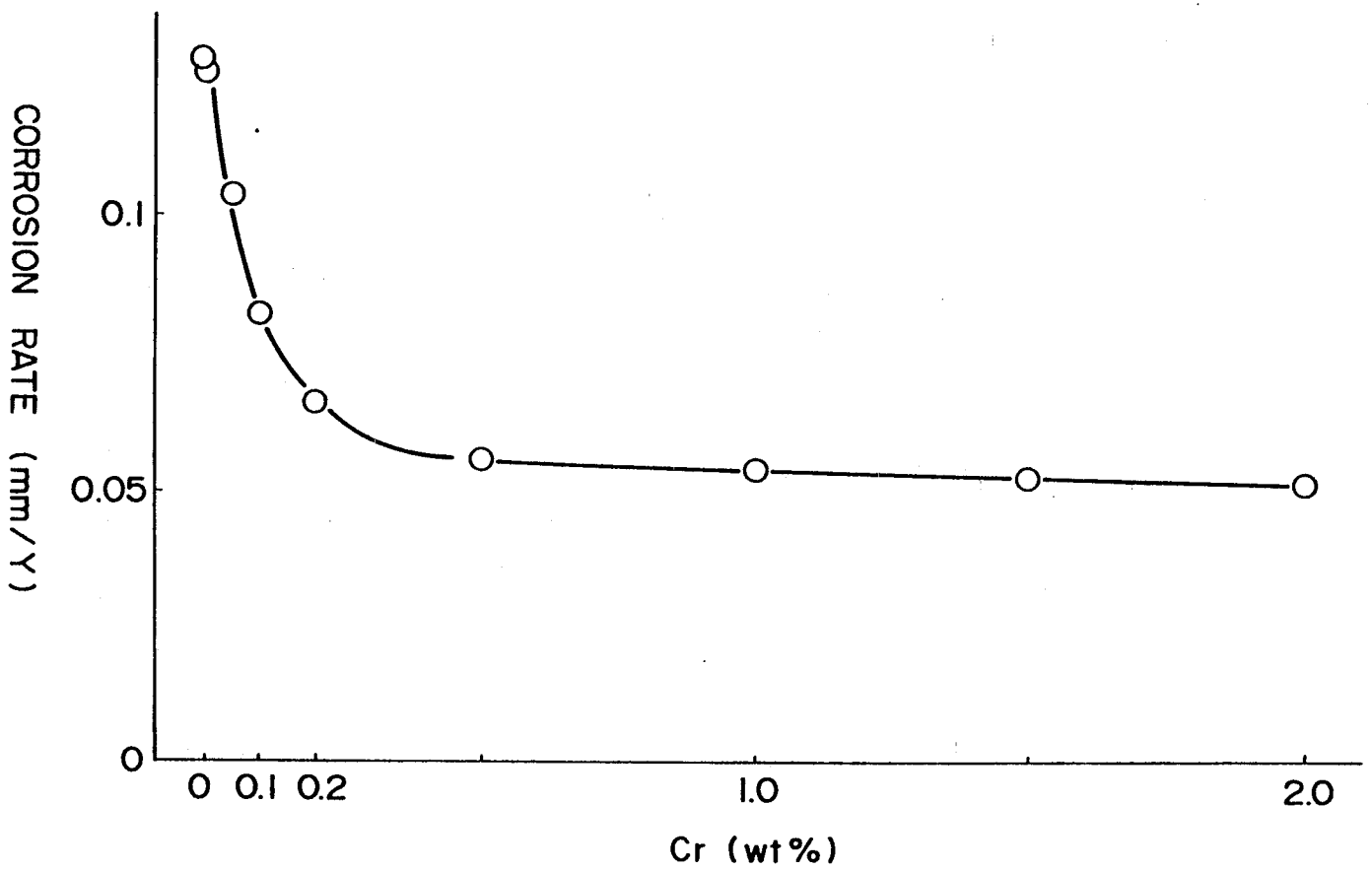
FIG. 2 is a graph illustrating the corrosion rate in a HCl immersion test in which the Cr content is varied while the content of other ingredients is made constant.

FIG. 2 shows the results of the immersion test for Ti based alloy in a boiling 2% HCl solution for 24 hours in which the content is made constant for Ni as 0.4 wt %, Pd as 0.014 wt % and Ru as 0.026 wt % while the Cr content is varied.

That is, it can be seen that the corrosion resistance is apparently improved by defining the Cr content as 0.1 wt %.

Further, more excellent corrosion resistance than that of the material corresponding to G7 (Ti-0.15 Pd) is obtained when the Cr content is increased to 0.2 wt %.

Figure 3:
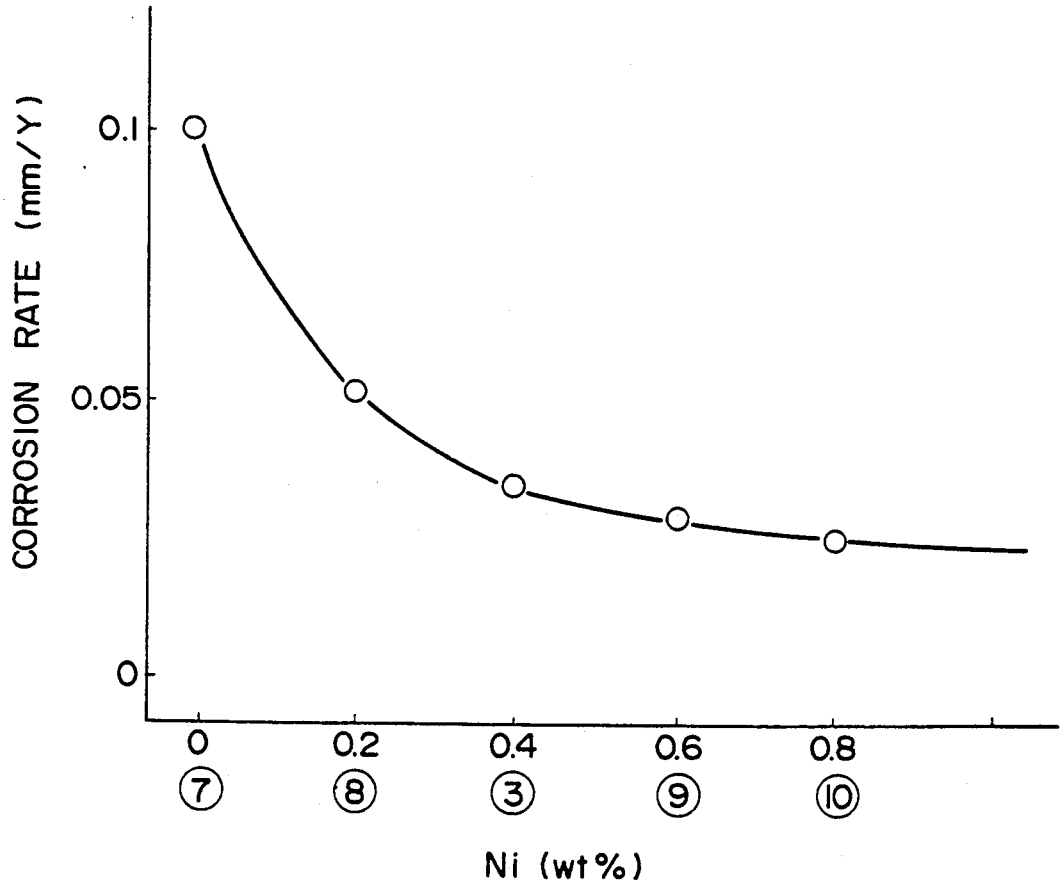
FIG. 3 is a graph illustrating the corrosion rate in a HCl immersion test in which the Ni content is varied while the content of other ingredients is made constant.

FIG. 3 shows the result of the immersion test in a boiling 2% HCl solution for the corrosion resistant Ti based alloy according to the present invention (invention in (claim 1)) for 24 hours in which the content made constant as 0.2 wt % for Cr, and as $Pd/Ru=\frac{1}{2}$, $Pd+Ru=0.04$ wt % while the Ni content is varied.

That is, it can be seen that the corrosion rate is reduced along with the increase of the Ni content.

Figure 4:
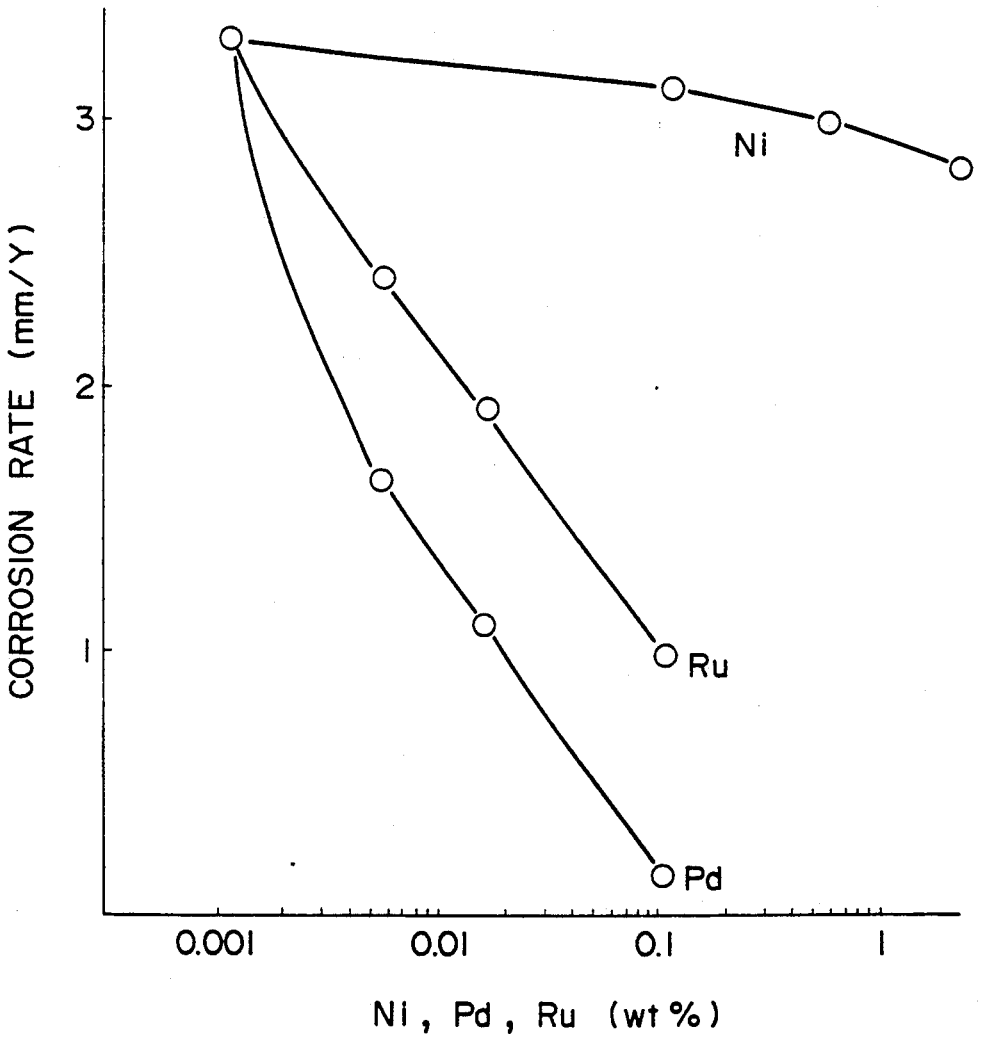
FIG. 4 is a graph illustrating the corrosion rate in a HCl immersion test in which the Cr content is made constant.

FIG. 4 shows the results of an immersion test for Ti based alloy in a boiling 2% HCl solution for 2 hours in which the content made constant as 0.2 wt % for Cr while the content for Ni, Pd and Ru is varied.

That is, it can be seen that the corrosion rate is reduced along with the increase of the content for Ni, Pd and Ru, and that the corrosion rate is further reduced with Pd and Ru than in the case of Ni and Pd than in the case of Ru.

Figure 5:
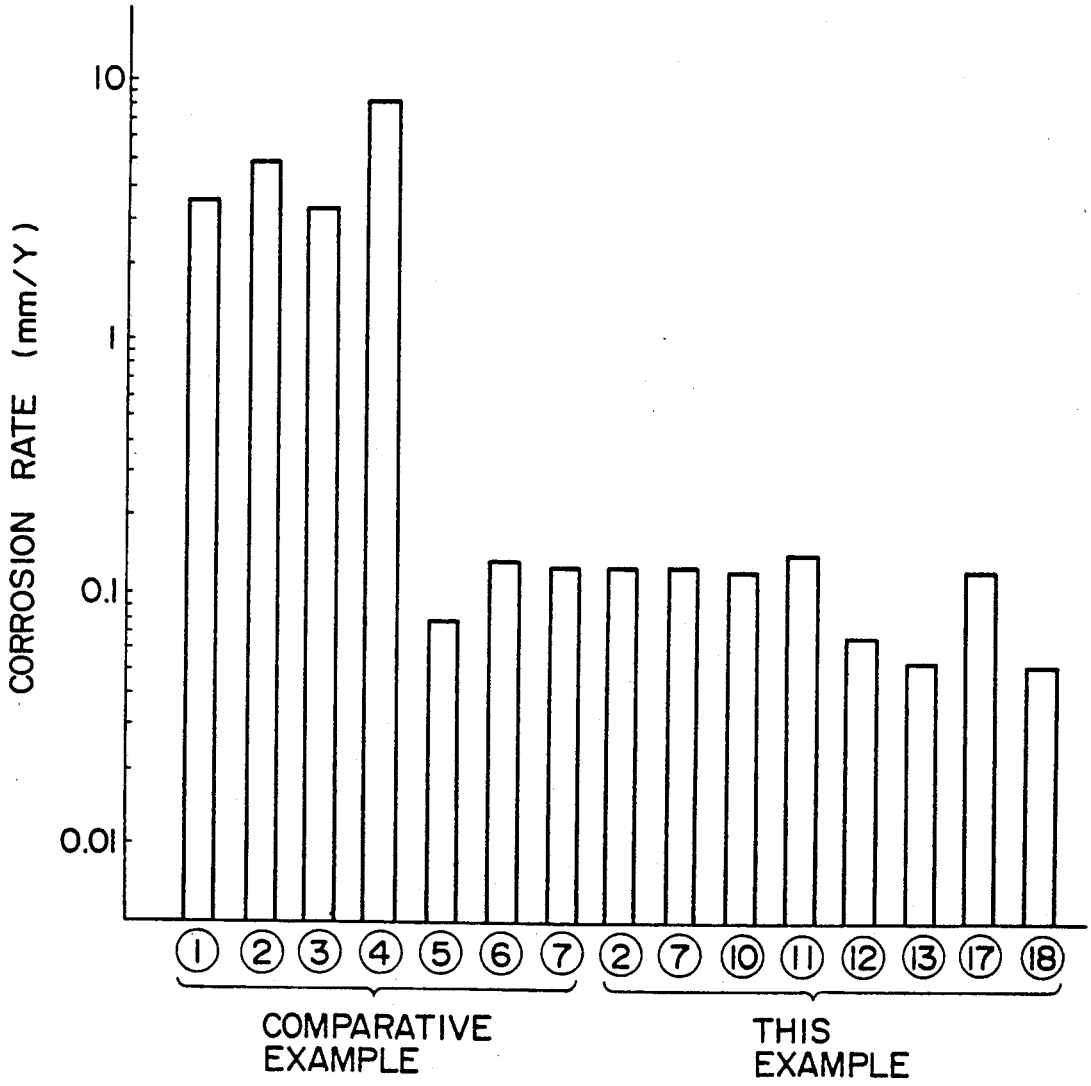
FIG. 5 is a graph illustrating the corrosion rate in a HCl immersion test for several examples of corrosion resistant Ti based alloy (corresponding to the invention in claim 1) according to the present invention and for comparative examples.

FIG. 5 shows the results of an immersion test in a boiling 2% HCl solution for several examples among corrosion resistant Ti based alloys 2–18 (invention in (claim 1)) according to the present invention, pure Ti (material corresponding to G2) of Comparative Example 1, Ti-0.7 Ni-0.3 Mo (material corresponding to G12) of Comparative Example 2, Ti-0.5 Ag (0.2 Ag) of Comparative Example 3 and Ti-0.5 Ni (0.5 Ni) of Comparative Example 4 shown in Table 1 for 24 hours.

That is, it is shown that the corrosion resistant Ti based alloy according to the present invention has a corrosion rate equal to or less than that of Ti-(Td-Ru) in Comparative Examples 5–7 and is excellent, and the corrosion rate is remarkably lower than that of the Ti based alloy of Comparative Examples 1–4.

Accordingly, it is shown that the corrosion resistant Ti based alloy according to the present invention (invention in (claim 1)) is excellent in the corrosion resistance in the non-oxidative atmosphere (extremely low corrosion rate).

EXAMPLE 2

In the same procedures as those in Example 1 shown in Tables 4 and 5, test pieces for the corrosion resistant Ti based alloy (invention in (claim 2)) according to the present invention and each of comparative examples were compared.

An evaluation test was conducted for the test specimens by the test described below.

Evaluation was made based on the uniform corrosion rate in the immersion test in a boiling 5% HCl circumstance.

Test results are shown in Table 6.

From the Table 6, the descriptions below will be apparent.

That is, in Nos. 1–7 and Nos. 13–19, when the content for the Si and Cu are made constant while the content of other ingredients is varied, the corrosion rate is reduced along with the increase of the Ni content in Nos. 1-3 and Nos. 13-15, the corrosion rate is reduced along with increase of the Pd content in Nos. 16 and 17, and the corrosion rate is reduced along with increase of the Ru content in Nos. 6 and 7 and Nos. 18 and 19. Further, Nos. 8-12 and Nos. 20-26 show examples comprising a combination of various kinds of ingredients and all of which show remarkably reduced corrosion rate as compared with Nos. 1-5 and Nos. 7 and 8 of comparative examples.

42% $MgCl_2$ Crevice Corrosion Immersion Test

In this test, evaluation was made based on the number of occurrence of the crevice corrosion by the same procedures as those in Example 1. That is, the rate of occurrence of the crevice corrosion was examined and evaluated in an immersion test by multicrevice method using the jig shown in FIG. 1 and in a boiling 42% $MgCl_2$ circumstance like that of Example 1.

Table 7 shows the results for the crevice corrosion resistance test.

As can be seen from Table 7, the corrosion resistant Ti based alloy according to the present invention (invention in (claim 2)) shows excellent crevice corrosion resistance.

TABLE 4

| | Chemical ingredient (wt %) | | | | | |
|---|---|---|---|---|---|---|
| | Si | Cu | Ni | Pd | Ru | Ti |
| This invention | | | | | | |
| 1 | 0.2 | — | 0.05 | — | — | Balance |
| 2 | 0.2 | — | 0.5 | — | — | " |
| 3 | 0.2 | — | 0.2 | — | — | " |
| 4 | 0.2 | — | — | 0.005 | — | " |
| 5 | 0.2 | — | — | 0.1 | — | " |
| 6 | 0.2 | — | — | — | 0.005 | " |
| 7 | 0.2 | — | — | — | 0.1 | " |
| 8 | 0.2 | — | — | 0.006 | 0.015 | " |
| 9 | 0.2 | — | 0.5 | 0.015 | 0.025 | " |
| 10 | 0.005 | — | 0.5 | 0.015 | 0.025 | " |
| 11 | 0.1 | — | 0.5 | 0.015 | 0.025 | " |
| 12 | 1.5 | — | 0.5 | 0.015 | 0.025 | " |
| 13 | — | 0.2 | 0.05 | — | — | " |
| 14 | — | 0.2 | 0.5 | — | — | " |
| 15 | — | 0.2 | 2.0 | — | — | " |
| 16 | — | 0.2 | — | 0.005 | — | " |
| 17 | — | 0.2 | — | 0.1 | — | " |

TABLE 5

| | Chemical ingredient (wt %) | | | | | |
|---|---|---|---|---|---|---|
| | Si | Cu | Ni | Pd | Ru | Ti |
| This invention | | | | | | |
| 18 | — | 0.2 | — | — | 0.005 | Balance |
| 19 | — | 0.2 | — | — | 0.1 | " |
| 20 | — | 0.2 | — | 0.006 | 0.015 | " |
| 21 | — | 0.2 | 0.5 | 0.015 | 0.025 | " |
| 22 | — | 0.005 | 0.5 | 0.015 | 0.025 | " |
| 23 | — | 0.1 | 0.5 | 0.015 | 0.025 | " |
| 24 | — | 1.5 | 0.5 | 0.015 | 0.025 | " |
| 25 | 0.005 | 0.005 | 0.5 | 0.015 | 0.025 | " |
| 26 | 0.1 | 0.1 | 0.5 | 0.015 | 0.025 | " |
| Comparative Example | | | | | | |
| 1 | Pure Ti (material corresponding to G2) | | | | | |
| 2 | Ri - 0.8 Ni - 0.3 Mo (material corresponding to G12) | | | | | |
| 3 | 0.2 | — | — | — | — | Balance |
| 4 | — | 0.2 | — | — | — | " |
| 5 | — | — | 0.5 | — | — | " |
| 6 | — | — | — | 0.15 | — | " |
| 7 | — | — | — | — | 0.15 | " |
| 8 | — | — | 0.5 | 0.015 | 0.015 | " |

TABLE 6

| | Corrosion rate (mm/y) | | Corrosion rate (mm/y) |
|---|---|---|---|
| This invention | | This invention | |
| 1 | 22.329 | 19 | 0.902 |
| 2 | 11.358 | 20 | 0.799 |
| 3 | 9.158 | 21 | 0.589 |
| 4 | 6.208 | 22 | 0.401 |
| 5 | 0.983 | 23 | 0.309 |
| 6 | 4.001 | 24 | 0.245 |
| 7 | 1.534 | 25 | 0.310 |
| 8 | 1.608 | 26 | 0.299 |
| 9 | 0.627 | Comparative Example | |
| 10 | 0.324 | 1 | 27.995 |
| 11 | 0.288 | 2 | 42.908 |
| 12 | 0.267 | 3 | 36.842 |
| 13 | 20.946 | 4 | 34.529 |
| 14 | 9.580 | 5 | 16.528 |
| 15 | 8.527 | 6 | 0.208 |
| 16 | 4.687 | 7 | 5.642 |
| 17 | 0.734 | 8 | 1.023 |
| 18 | 3.200 | | |

TABLE 7

| | Occurrence of crevice corrosion | | Occurrence of crevice corrosion |
|---|---|---|---|
| This invention | | This invention | |
| 1 | ○ | 19 | ○ |
| 2 | ○ | 20 | ○ |
| 3 | ○ | 21 | ○ |
| 4 | ○ | 22 | ○ |
| 5 | ○ | 23 | ○ |
| 6 | ○ | 24 | ○ |
| 7 | ○ | 25 | ○ |
| 8 | ○ | 26 | ○ |
| 9 | ○ | Comparative Example | |
| 10 | ○ | 1 | x |
| 11 | ○ | 2 | x |
| 12 | ○ | 3 | ○ |
| 13 | ○ | 4 | x |
| 14 | ○ | 5 | ○ |
| 15 | ○ | 6 | ○ |
| 17 | ○ | 7 | x |
| 18 | ○ | 8 | x |

○ - no crevice corrosion occurred
x - crevice corrosion occurred

EXAMPLE 3

In the same procedures as those in Example 1, test pieces for the corrosion resistant Ti based alloy (invention in (claim 3)) according to the present invention and for each of comparative examples shown in Tables 8 and 9 were compared.

An evaluation test was conducted for the test specimens by the test described below.

42% $MgCl_2$ Crevice Corrosion Immersion Test

In this test, evaluation was made based on the number of occurrence of the crevice corrosion by the same procedures as those in Example 1. That is, the rate of occurrence of the crevice corrosion was examined and evaluated in an immersion test by the multicrevice method using the jig shown in FIG. 1 and in a boiling 42% $MgCl_2$ circumstance like that in Example 1.

Table 10 shows the results for the crevice corrosion resistance test.

As can be seen from Table 10, the corrosion resistant Ti based alloy according to the present invention (invention in (claim 2)) shows excellent crevice corrosion resistance.

TABLE 8

| | Chemical ingredient (wt %) | | | | | | | | |
|---|---|---|---|---|---|---|---|---|---|
| | Al | Ni | Rh | Os | Ir | Pd | Ru | Pt | Ti |
| This invention | | | | | | | | | |
| 1 | 0.05 | 0.05 | — | — | — | 0.05 | 0.05 | — | Balance |
| 2 | 1.0 | 1.0 | — | — | — | 1.0 | 1.0 | — | " |
| 3 | 1.5 | 2.0 | — | — | — | 1.25 | 1.25 | — | " |
| 4 | 0.05 | 0.2 | — | — | — | 0.1 | 0.1 | — | " |
| 5 | 0.5 | 0.2 | — | — | — | 0.1 | 0.1 | — | " |
| 6 | 2.0 | 0.2 | — | — | — | 0.1 | 0.1 | — | " |
| 7 | 0.2 | 0.05 | — | — | — | 0.1 | 0.1 | — | " |
| 8 | 0.2 | 0.5 | — | — | — | 0.1 | 0.1 | — | " |
| 9 | 0.2 | 2.0 | — | — | — | 0.1 | 0.1 | — | " |
| 10 | 0.2 | 0.5 | — | — | — | 0.05 | 0.1 | — | " |
| 11 | 0.2 | 0.5 | — | — | — | 0.5 | 0.1 | — | " |
| 12 | 0.2 | 0.5 | — | — | — | 1.25 | 0.1 | — | " |
| 13 | 0.2 | — | 0.1 | — | — | — | — | — | " |
| 14 | 0.2 | — | — | 0.1 | — | — | — | — | " |
| 15 | 0.2 | 0.5 | — | — | 0.1 | — | — | — | " |
| 16 | 0.2 | — | — | — | — | 0.1 | — | — | " |
| 17 | 0.2 | — | — | — | — | — | 0.1 | — | " |
| 18 | 0.2 | 0.5 | — | — | — | — | — | 0.1 | " |

TABLE 9

| | Chemical ingredient (wt %) | | | | | | | | |
|---|---|---|---|---|---|---|---|---|---|
| | Al | Ni | Rh | Os | Ir | Pd | Ru | Pt | Ti |
| This invention | | | | | | | | | |
| 19 | 0.1 | 0.5 | — | — | — | 0.05 | 0.05 | — | " |
| 20 | 0.2 | 0.25 | — | — | — | 0.05 | 0.05 | — | " |
| 21 | 0.2 | 0.25 | — | — | — | 0.05 | 0.05 | — | " |
| 22 | 0.2 | 0.5 | — | 0.04 | — | 0.02 | 0.02 | — | " |
| 23 | 0.2 | 0.5 | 0.01 | 0.02 | — | 0.02 | 0.02 | 0.02 | " |
| Comparative Example | | | | | | | | | |
| 1 | Pure Ti (material corresponding to G2) | | | | | | | | |
| 2 | Ti - 0.15 Pd (material corresponding to G7) | | | | | | | | |
| 3 | Ti - 0.8 Ni - 0.3 Mo (material corresponding to G12) | | | | | | | | |
| 4 | Ti - 0.5 Ni | | | | | | | | |
| 5 | Ti - 0.5 Al | | | | | | | | |
| 6 | Ti - 0.5 Pd | | | | | | | | |
| 7 | Ti - 0.5 Ru | | | | | | | | |
| 8 | Ti - 0.5 Pt | | | | | | | | |
| 9 | Ti - 0.5 Os | | | | | | | | |
| 10 | Ti - 0.5 Ir | | | | | | | | |
| 11 | Ti - 0.5 Rh | | | | | | | | |

TABLE 10

| | Crevice corrosion | | Crevice corrosion |
|---|---|---|---|
| This invention | | This invention | |
| 1 | ○ | 21 | ○ |
| 2 | ○ | 22 | ○ |
| 3 | ○ | 23 | ○ |
| 4 | ○ | Comparative Example | |
| 5 | ○ | 1 | x |
| 6 | ○ | 2 | ○ |
| 7 | ○ | 3 | ○ |
| 8 | ○ | 4 | x |
| 9 | ○ | 5 | x |
| 10 | ○ | 6 | ○ |
| 11 | ○ | 7 | ○ |
| 12 | ○ | 8 | ○ |
| 13 | ○ | 9 | ○ |
| 14 | ○ | 10 | ○ |
| 15 | ○ | 11 | ○ |
| 16 | ○ | | |
| 17 | ○ | | |
| 18 | ○ | | |
| 19 | ○ | | |
| 20 | ○ | | |

○ - no crevice corrosion occurred
x - crevice corrosion occurred

As apparent from Table 10, the corrosion resistant Ti based alloy according to the present invention (claim 3) shows excellent crevice corrosion resistance when it is immersed in a boiling 42% $MgCl_2$ solution for 42 hours.

Figure 6:
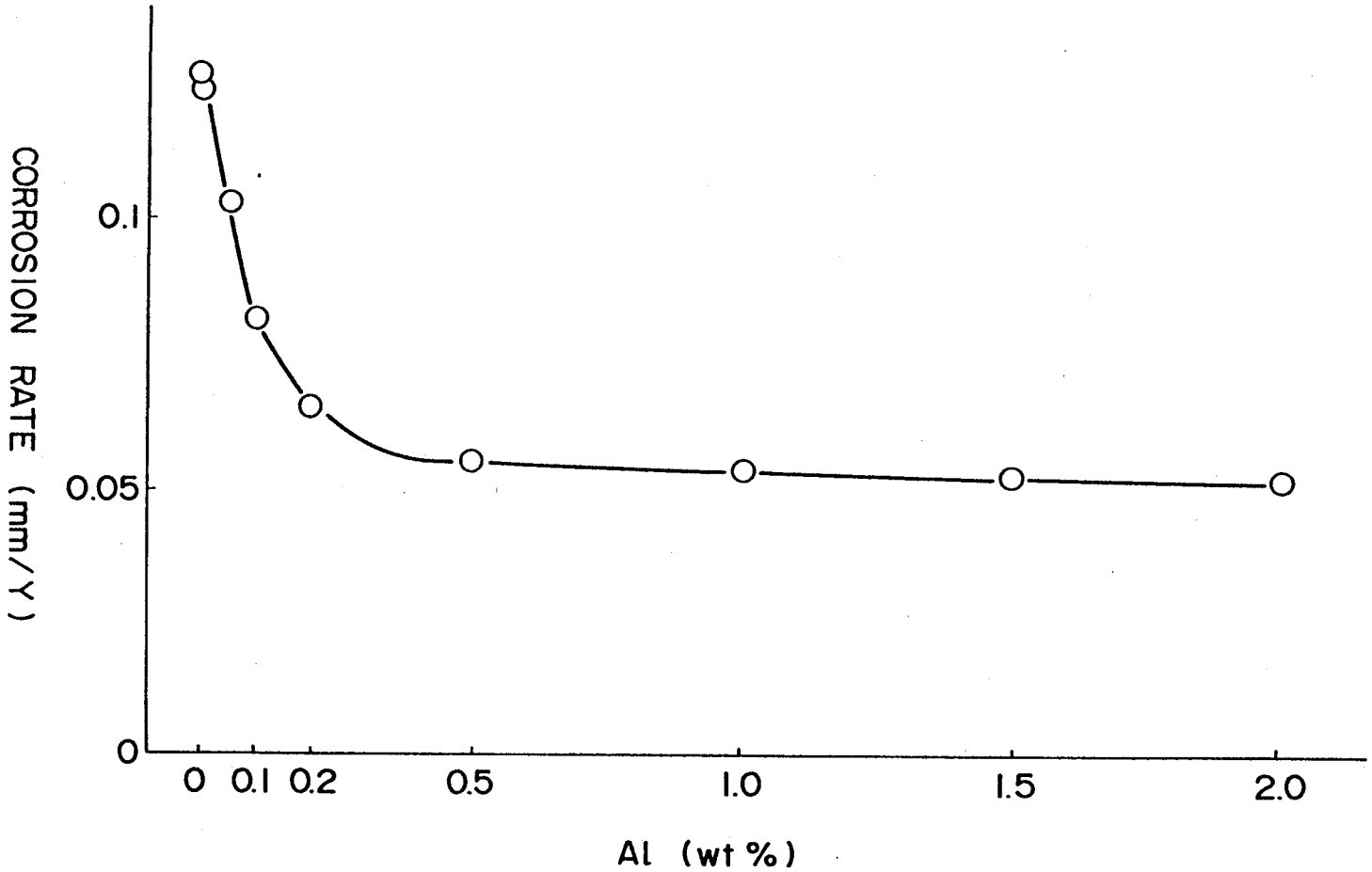
FIG. 6 is a graph illustrating the corrosion rate in a HCl immersion test in which the Al content is varied while the content of other ingredients is made constant.
Figure 7:
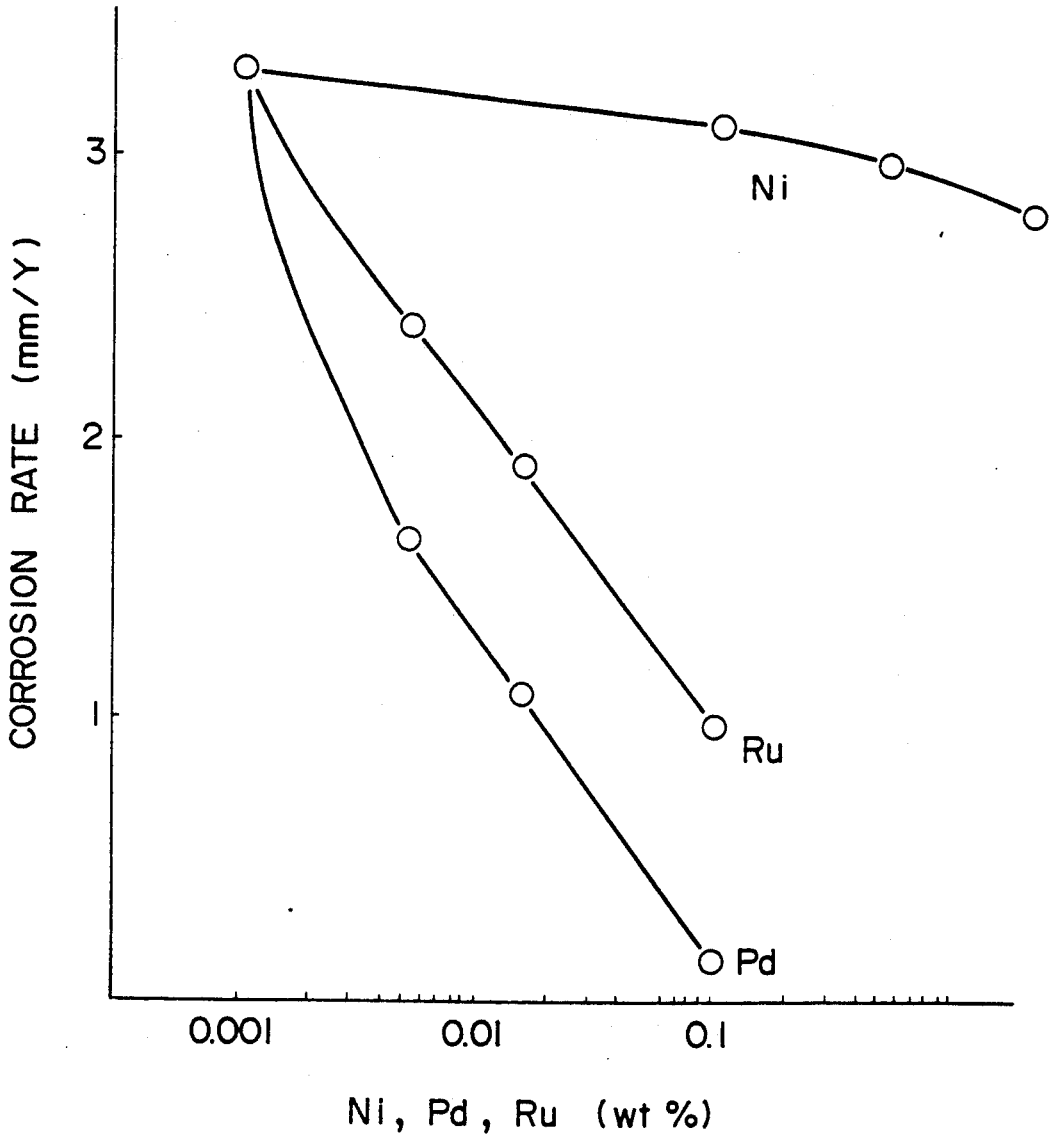
FIG. 7 is a graph illustrating the corrosion rate in a HCl immersion test in which the content of Ni, Pd and Rh is varied while the Al content is made constant.
Figure 8:
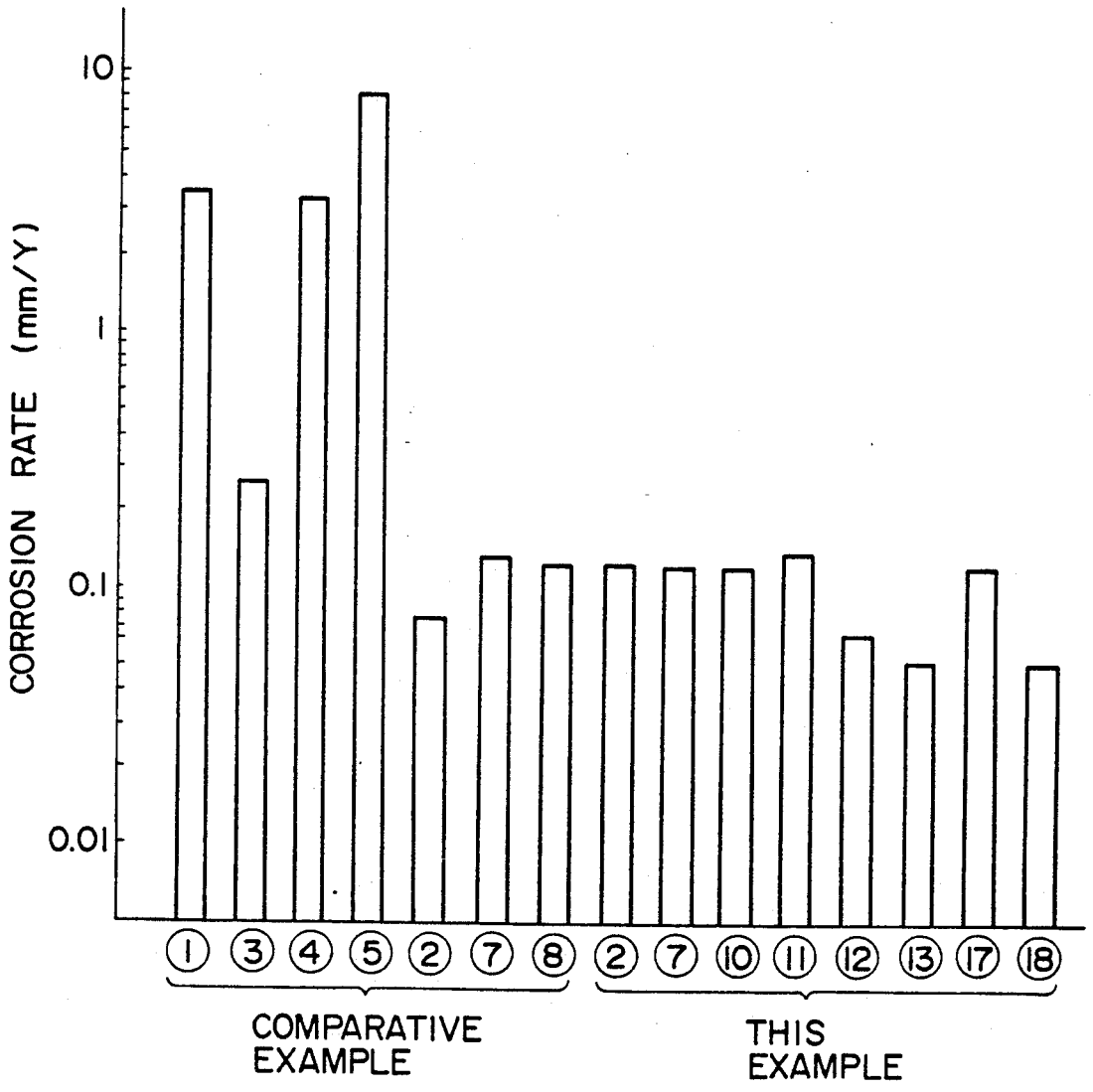
FIG. 8 is a graph illustrating the corrosion rate in a HCl immersion test for several examples of corrosion resistant Ti based alloy (corresponding to the invention in claim 3) according to the present invention and for comparative examples.
Figure 9A:
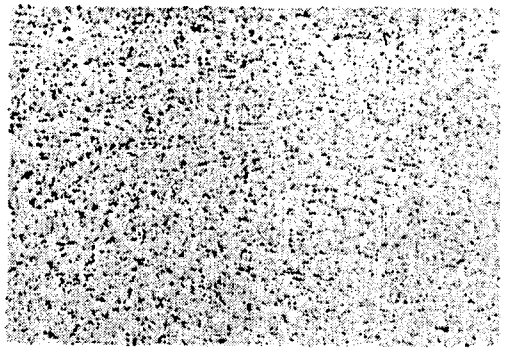
FIGS. 9A–9D are microstructure photographs for the present forged and cold-rolled materials.
Figure 9B:
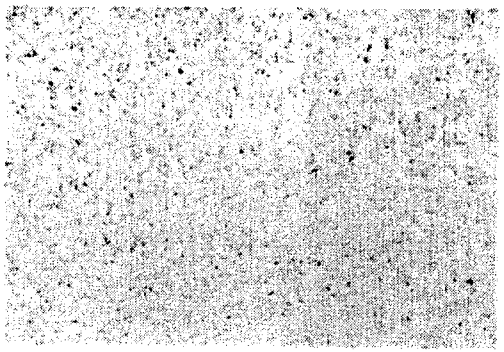
Figure 9C:
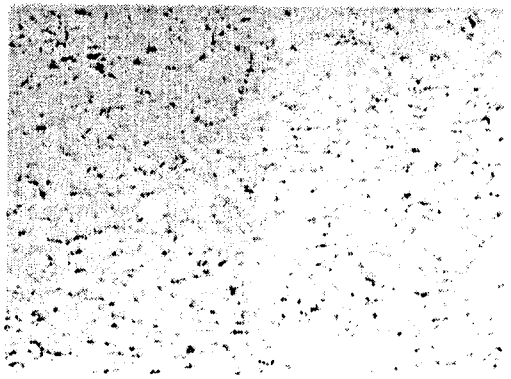
Figure 9D:
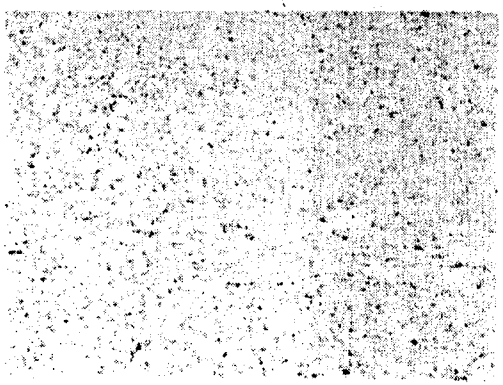
Figure 10A:
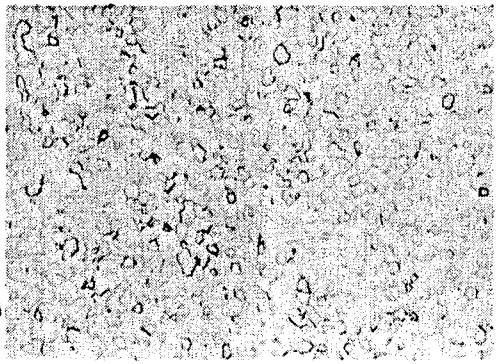
FIGS. 10A–10D are microstructure photographs for the comparative materials.
Figure 10B:
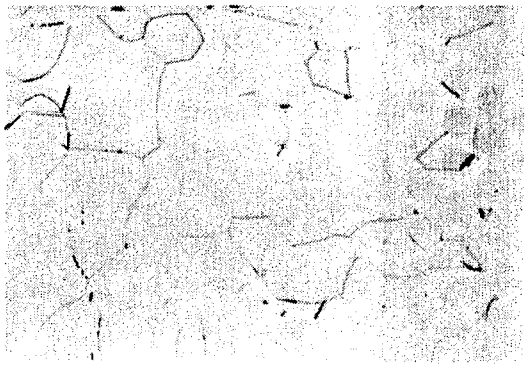
Figure 10C:
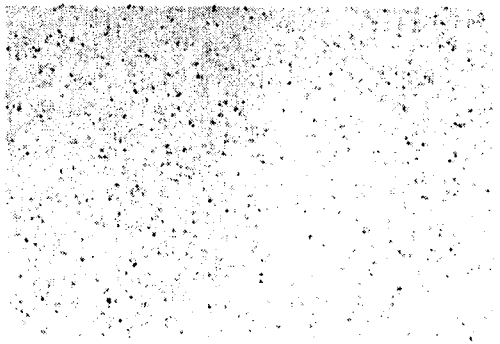
Figure 10D:
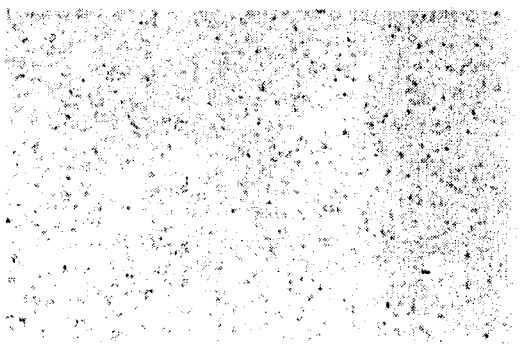

Description will then be made to an entire surface corrosion resistance evaluation test for the corrosion resistant Ti based alloy according to the present invention (invention in (claim 3)) against hydrochloric acid with reference to FIGS. 6, 7 and 8.

FIG. 6 shows the results of an immersion test for Ti based alloy in a boiling 2% HCl solution for 24 hours in which the content was made constant as 0.2 wt % for Ni, as 0.01 wt % for Pd and as 0.1 wt % for Rh while the Al content is varied.

That is, it can be seen that the corrosion resistance is remarkably improved by defining the Al content as greater than 0.2 wt %.

Further, more excellent corrosion resistance than that of the material corresponding to G7 (Ti-0.15 Pd) was shown when the Al content is increased to 0.5 wt %.

FIG. 7 shows the result of an immersion test in a boiling 2% HCl solution for the corrosion resistant Ti based alloy according to the present invention (invention in (claim 3)) for 24 hours in which the content was made constant as 0.2 wt % for Al, while the Ni content is varied.

That is, the corrosion rate is reduced along with the increase of the content for Ni, Pd and Ru, and the corrosion rate is reduced further with Pd or Ru than in the case of Ni and Pd further with Pd than in the case of Rh, to provide excellent effect.

FIG. 8 shows the results of an immersion test in a boiling 2% HCl solution for 24 hours for several examples of corrosion resistant Ti based alloys 2–18 according to the present invention (invention in (claim 3)), pure Ti (material corresponding to G2) of Comparative Example 1, Ti-0.15 Pd (material corresponding to G7) of Comparative Example 2, Ti-0.8 Ni-0.3 Mo (material corresponding to G12) of Comparative Example 3 shown in Table 7.

That is, it is shown that the corrosion resistant Ti based alloys according to the present invention (invention in (claim 3)) are excellent having a corrosion rate equal with or less than that of Ti-(Pd, Rh, Pt) materials in the Comparative Examples 2, 7 and 8 and having the corrosion rate is being remarkably smaller than that of the Ti based alloy of Comparative Examples 3, 4 and 5.

EXAMPLE 4

As the material used for the test, a melted test material applied with forging (material 1 according to the present invention) or cold working (material 2 according to the present invention) were used. Comparative material were commercially available pure titanium (Comparative Example 1, corresponding to JIS: second class), commercially available Ti-Pd alloy (Comparative Example 2, corresponding to JIS class: 12), as well as Ti-Ni-Ru series alloy as Comparative Example 3 and Ti-Pd-Co series alloy as comparative Example 4 were also evaluated together.

Chemical composition for each of the materials to be served for the test are shown in Table 11.

Evaluation tests to be described later were conducted.

Microstructure Observation

The microstructure at the surface and the cross section in each of the test materials was observed by using an optical microscope. Number of specimens=one for each.

FIGS. 9A-9D and 10A-10D show microstructure photographs for the forged material according to the present invention, cold-rolled material according to the present invention and comparative material. In the Ti alloy according to the present invention, both of the forged material and the cold-rolled material exhibit microstructure comprising refined regular system crystal grains and no acicular structure was observed. Hv. Hardness Measurement As an evaluation for the measure of the workability and the moldability, Hv. hardness measurement was conducted (load: 97 N, retention time: 30 sec) to calculate average Hv. hardness. Number of specimens=2 for each.

Figure 11:
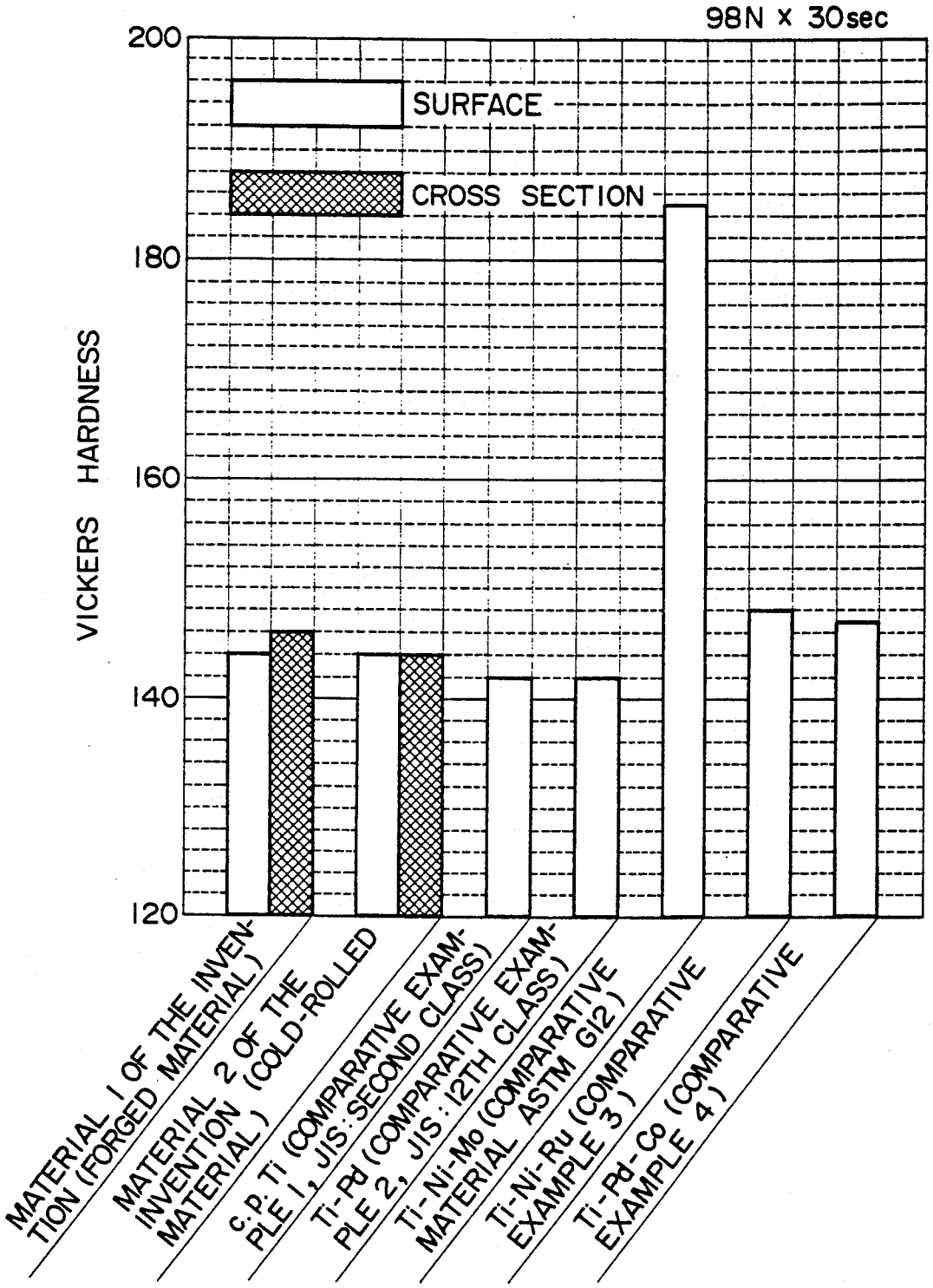
FIG. 11 is a graph illustrating the Hv. hardness for each of the tested materials.

FIG. 11 shows the Hv. hardness for each of the tested materials. It can be seen that both of the forged material and the cold-rolled material in accordance with the present invention had Hv. hardness comparable with that of pure titanium.

Uniform Corrosion Resistance

An immersion test (24 hr) was conducted in an aqueous boiling solutions of hydrochloric acid at each of 2, 5 and 10% concentration and the uniform corrosion rate (mm/year) was calculated based on the loss of weight by corrosion. Number of specimen=2 for each.

Figure 12:
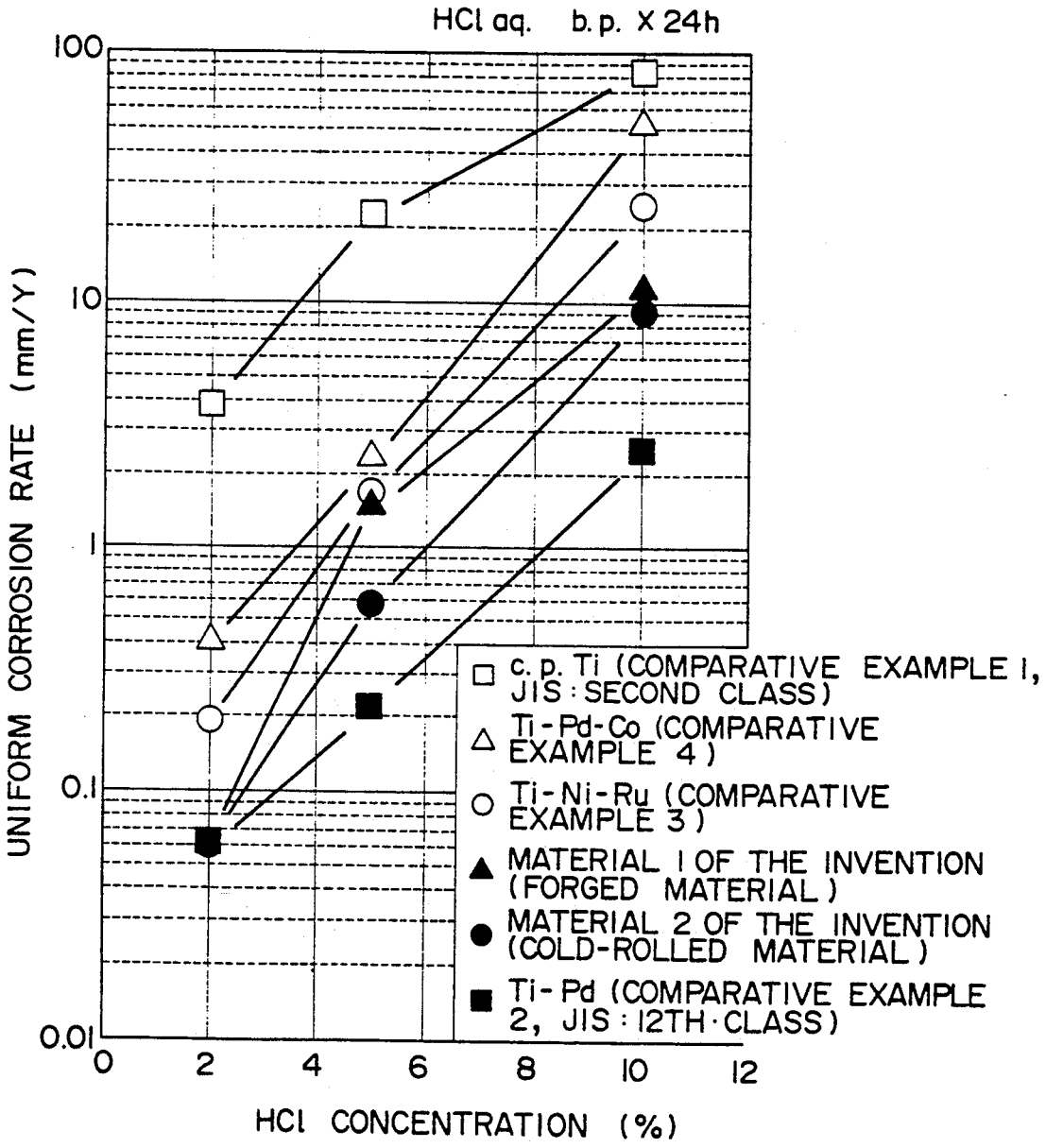
FIG. 12 is a graph illustrating the uniform corrosion rate in an aqueous boiling solution of hydrochloric acid at each of 2, 5 and 10% concentration for the present forged and cold-rolled materials and the comparative materials.

FIG. 12 shows the uniform corrosion rate in an aqueous boiling solution of hydrochloric acid at each of 2, 5 and 10% concentration for the forged material and the cold-rolled material in accordance with the present invention and the comparative material. At each of the HCl concentrations, the forged material and the cold-rolled material in accordance with the present invention showed excellent uniform corrosion resistance. Further, in an aqueous 2% hydrochloric acid solution, it showed uniform corrosion resistance comparable with that of the Ti-Pd alloy.

Crevice Corrosion Resistance

An immersion test in an aqueous boiling 42% magnesium chloride solution (100 hr) was conducted by using a multicrevis method, to determine the probability for the occurrence of crevice corrosion (%). Number of test specimens=4 for each.

Figure 13:
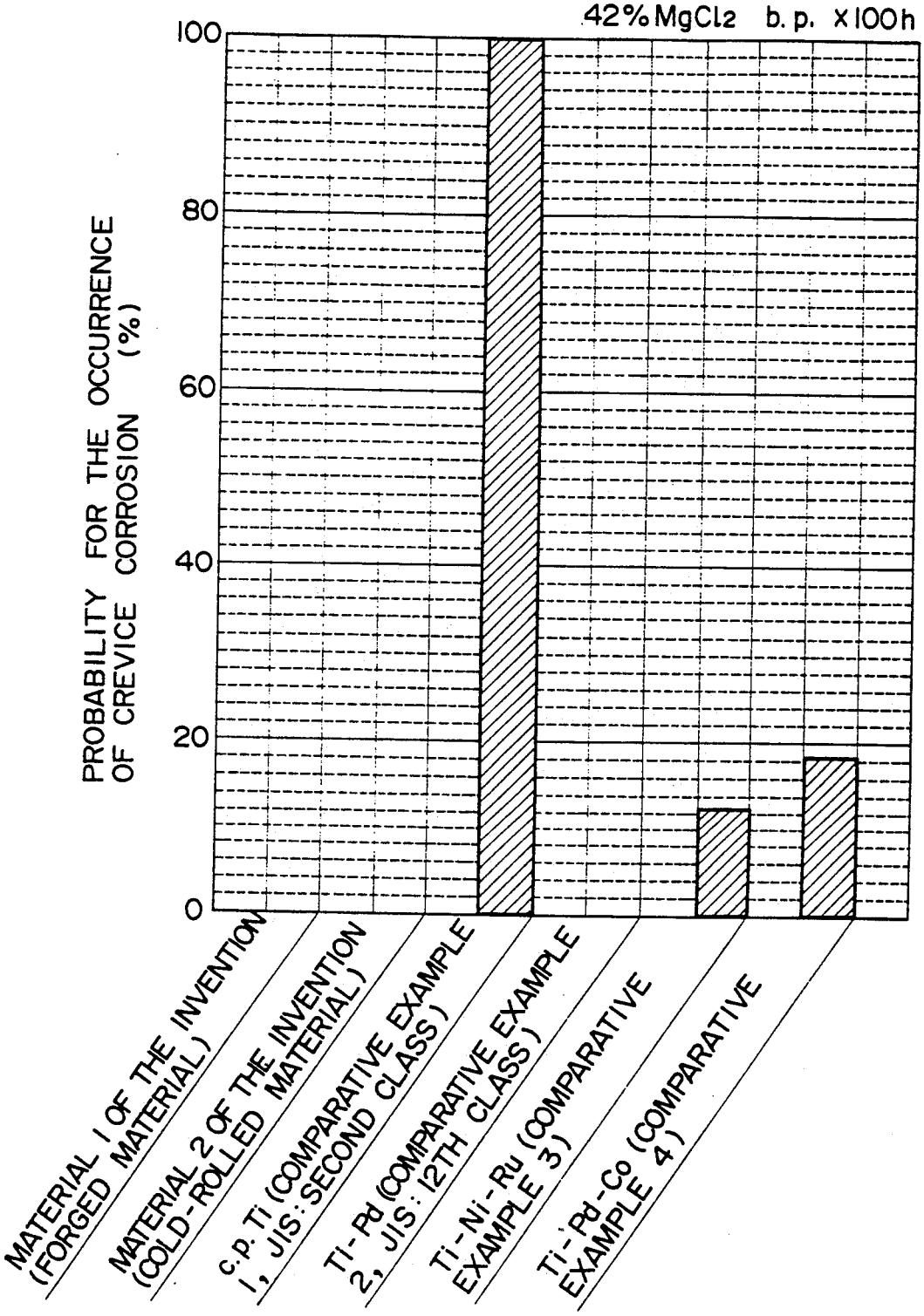
FIG. 13 is a graph illustrating the probability for the occurrence of crevice corrosion in an aqueous boiling 42% solution of magnesium chloride for the present forged and cold-rolled materials and the comparative materials.

FIG. 13 shows the probability for the occurrence of crevice corrosion in an aqueous boiling 42% solution of magnesium chloride for the forged material and cold-rolled material in accordance with the present invention and the comparison material. In the Ti alloy according to the present invention, both of the forged material and the cold-rolled material showed no occurrence of the crevice corrosion at all under the conditions of this test in the same manner as in the Ti-Pd alloy.

Immersion Test in a Boiling Aqueous 10% Hydrochloric Acid Solution for Simulated Welded Specimen For the comparative evaluation of the uniform corrosion resistance in a welded portion, an immersion test in a boiling aqueous 10% hydrochloric acid solution (24 hr) was conducted for the test specimen in which a middle portion was melted by TIG welding, to calculate the corrosion rate (mm/year) based on the weight loss by corrosion and it was compared with the test specimen with no such welded portion. Number of test specimens=4 for each.

Figure 14:
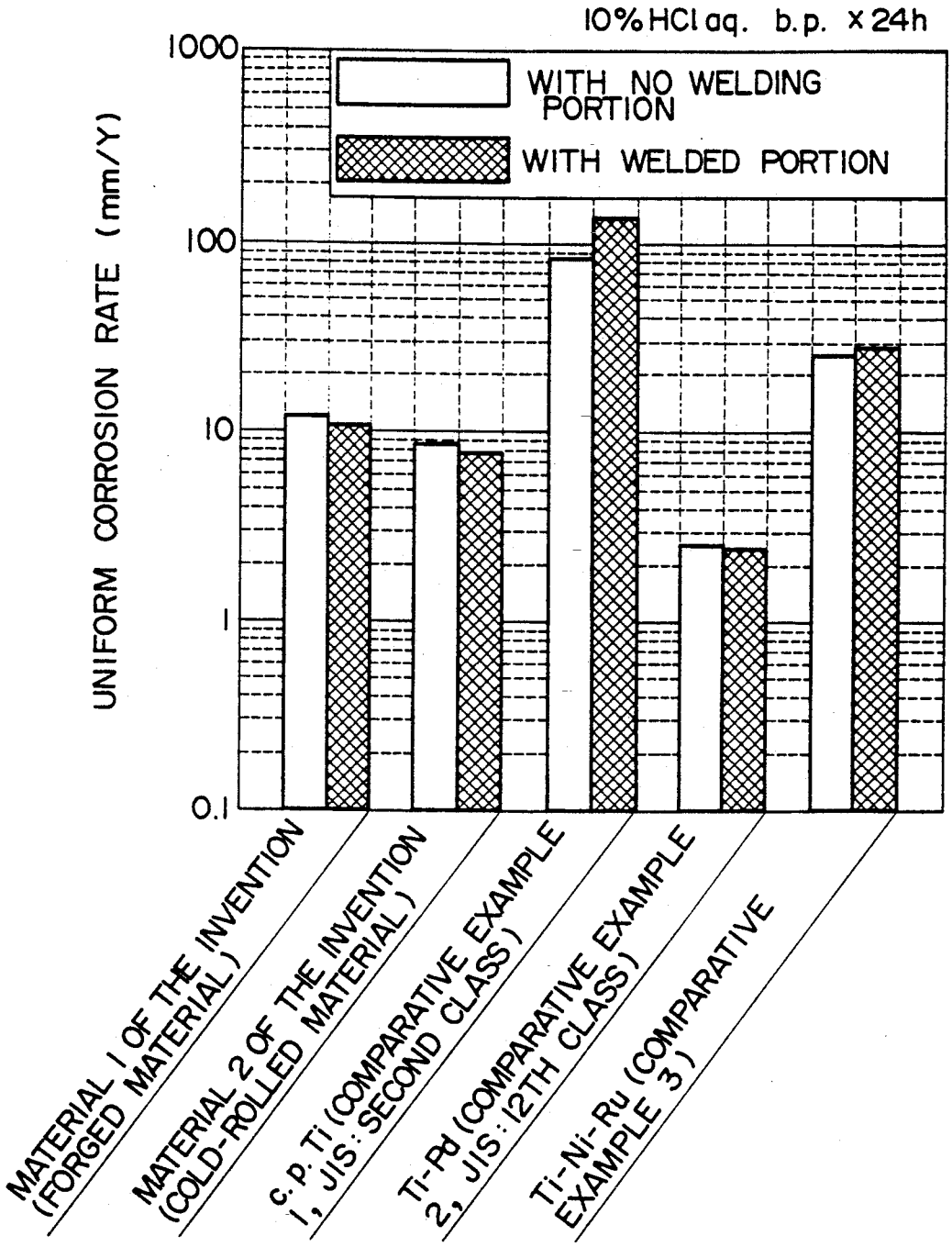
FIG. 14 is a graph illustrating the uniform corrosion rate in the boiling aqueous 10% hydrochloric acid solution for the Ti alloys according to the present invention and the comparative materials remelted by TIG weld electrodes.
Figure 15A:
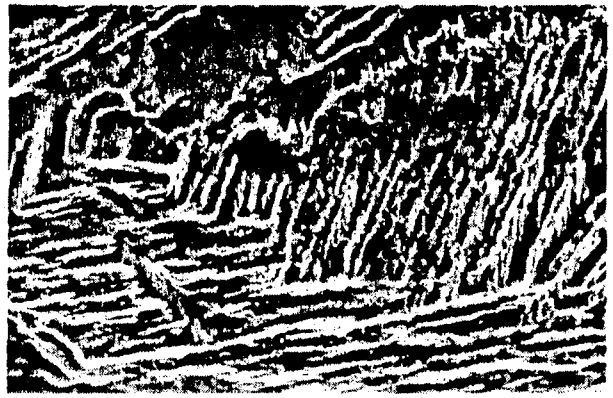
FIGS. 15A–15D are photographs showing the surface of the simulated weld specimen after an immersion test in a boiling aqueous 10% hydrochloric acid solution.
Figure 15B:
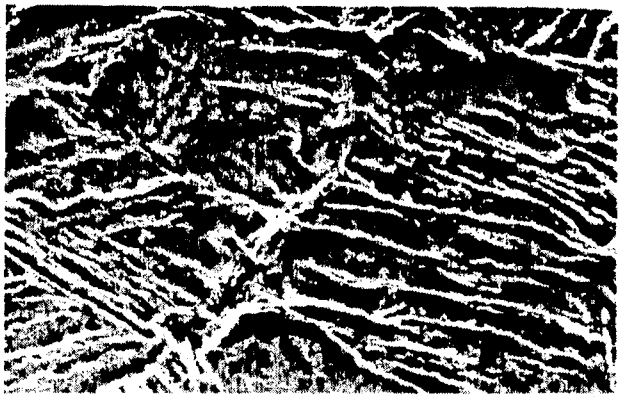
Figure 15C:
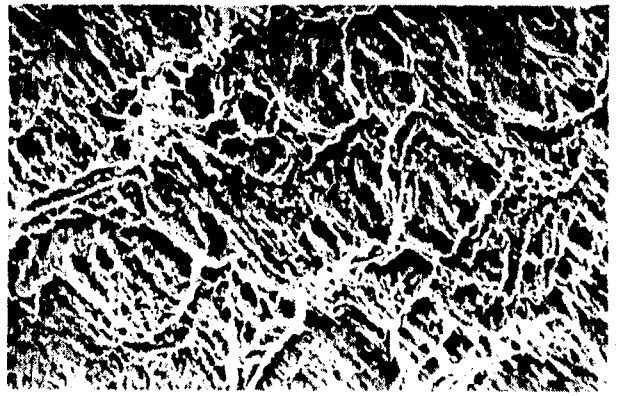
Figure 15D:
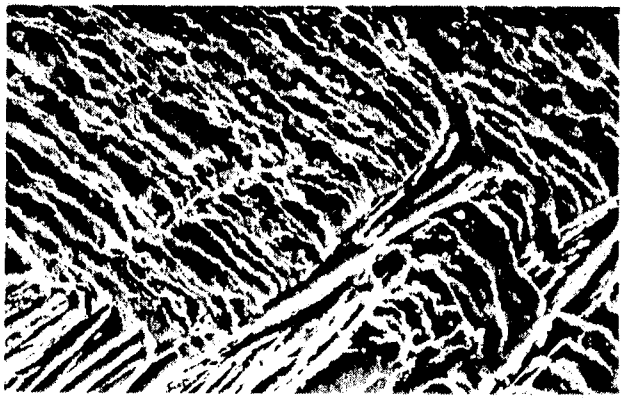

FIG. 14 shows the uniform corrosion rate in the boiling aqueous 10% hydrochloric acid solution for the Ti alloy according to the present invention and the comparative material remelted by TIG weld electrodes. Further, FIGS. 15A-15D show the surface of the simulated weld specimen after an immersion test in a boiling aqueous 10% hydrochloric acid solution. In the Ti alloy according to the present invention, degradation in the uniform corrosion resistance caused by the welding is recognized neither for the forged material nor for the cold-rolled material. Further, when the surface of the specimen was observed after the test, no local corrosion caused by Ni segregation was recognized.

From the results, it can be seen that the Ti alloys according to the present invention have the following function:

(1) Uniform corrosion resistance in hydrochloric acid is excellent which is comparable with that of Ti-Pd alloy in a hydrochloric acid at low concentration.
(2) Crevice corrosion resistance is excellent which is comparable with that of Ti-Pd alloy under the conditions of this test.
(3) Workability and moldability equal with those of pure titanium can be expected.
(4) Corrosion resistance is not deteriorated at all even in the welded portion.

TABLE 11

| | Chemical ingredient for Each of test materials | | | | | | | | |
|---|---|---|---|---|---|---|---|---|---|
| | Ni | Pd | Ru | Cr | Co | O | N | H | Fe |
| This invention 1 (forged) | 0.41 | 0.01 | 0.02 | 0.14 | — | 0.082 | 0.003 | 0.008 | 0.018 |
| This invention 2 (cold-rolled) | 0.41 | 0.01 | 0.02 | 0.14 | — | 0.077 | 0.003 | 0.002 | 0.015 |
| Comparative Example 1 c.p.Ti (JIS: second class) | — | — | — | — | — | 0.087 | 0.004 | 0.004 | 0.060 |
| Compartive Example 2 Ti—Pd alloy (JIS: 12th class) | — | 0.16 | — | — | — | 0.097 | 0.004 | 0.0032 | 0.036 |
| Comparative Example 3 Ti—Ni—Ru alloy | 0.54 | — | 0.04 | — | — | 0.052 | 0.0036 | 0.0024 | 0.021 |
| Comparative Example 4 Ti—Pd—Co alloy | — | 0.06 | — | — | 0.34 | 0.069 | 0.0060 | 0.002 | 0.073 |

As has been described above, since the corrosion resistant Ti based alloy according to the present invention has the above-mentioned constitution, it is excellent in the corrosion resistance in a non-oxidative circumstance and, further, has excellent crevice corrosion resistance as well, and it is an extremely excellent Ti based alloy of high corrosion resistance remarkably improved for the problem in the existent corrosion resistant Ti based alloys.

What is claimed is:

1. A corrosion resistant Ti based alloy comprising:

Cr: 0.005-2.0 wt %, Ni: 0.005-2.0 wt %, and further comprising one of more of elements selected from the group consisting of Pd: 0.005–2.0 wt %, Ru: 0.005–2.0 wt %, Pt: 0.005–2.0 wt %, -continued Os: 0.005–2.0 wt %, Ir: 0.005–2.0 wt %
Rh: 0.005–2.0 wt %, and the balance of Ti and inevitable impurities.

* * * * *